US006386320B1

(12) United States Patent
Clavel

(10) Patent No.: US 6,386,320 B1
(45) Date of Patent: May 14, 2002

(54) PORTABLE SUPPORT STRUCTURE USEFUL AS LADDER OR STEPLADDER

(76) Inventor: Bernard Clavel, 34 rue Baudin, 92400 Courbevoie (FR)

( * ) Notice: Subject to any disclaimer, the term of this patent is extended or adjusted under 35 U.S.C. 154(b) by 0 days.

(21) Appl. No.: 09/786,295

(22) PCT Filed: Jul. 30, 1999

(86) PCT No.: PCT/FR99/01935

§ 371 Date: Feb. 26, 2001

§ 102(e) Date: Feb. 26, 2001

(87) PCT Pub. No.: WO00/14373

PCT Pub. Date: Mar. 16, 2000

(30) Foreign Application Priority Data

Sep. 4, 1998 (FR) ..... 98 11176

(51) Int. Cl.[7] ..... E06C 1/00

(52) U.S. Cl. ..... 182/165; 182/106; 182/173; 182/194

(58) Field of Search ..... 182/93, 97, 107, 182/106, 165, 173, 194

(56) References Cited

U.S. PATENT DOCUMENTS 68,193 A * 7/1867 Hedden ..... 182/165
322,414 A * 7/1885 Brownson ..... 182/165
791,509 A * 6/1905 Soergel ..... 182/165
1,511,580 A * 10/1924 Prince ..... 182/165
1,976,345 A * 10/1934 Hruby ..... 228/31
4,199,040 A * 4/1980 Lapeyre ..... 182/106 X
4,316,524 A * 2/1982 Lapeyre ..... 182/106 X
4,535,871 A * 8/1985 Lapeyre ..... 182/93
5,125,476 A * 6/1992 Merrick ..... 182/97
6,076,634 A * 6/2000 Simon ..... 182/93 X
6,206,139 B1 * 3/2001 Bogart, Jr. ..... 182/173
6,260,662 B1 * 7/2001 Meister et al. ..... 182/106

* cited by examiner

*Primary Examiner*—Bruce A. Lev
(74) *Attorney, Agent, or Firm*—William A. Drucker

(57) ABSTRACT

The invention concerns a support structure characterized in that it comprises at least: a shaft (1) whereof the two ends are designed to be urged to rest on two fixed elements, one of which may be the ground and the other, a fixed object located above the ground; two series of steps ($M_1$, $M'_{1-2}$, $M'_2$–$M_3$, $M'_3$) fixed on the shaft, on either side thereof respectively; and a ramp (7), integral with the shaft (1) extending vertically with respect thereto, at a distance from the steps ($M_1$, $M'_1$–$M_2$, $M'_2$–$M_3$, $M'_3$) less than the average length of a leg, such that a user can move on the steps ($M_1$, $M'_1$–$M_2$, $M'_2$–$M_3$, $M'_3$) by striding over the ramp (7). Said structure enables the user to stand on the steps with greater stability while keeping his hands free.

11 Claims, 4 Drawing Sheets

PORTABLE SUPPORT STRUCTURE USEFUL AS LADDER OR STEPLADDER

BACKGROUND OF THE INVENTION

1. Field of the Invention

The present invention relates to a portable support structure, possibly foldable, able to be used as a ladder or stepladder to enable a person to move, especially going up or down, for example to reach objects otherwise inaccessible or for getting past obstacles.

2. Description of the Prior Art

Generally speaking, it is known that conventional ladders are made up of two parallel or slightly convergent stanchions recombined from place to place by transversal bars or ladder rungs used as steps.

At one of their extremities, these stanchions have support surfaces on the ground and possibly equipped with bolsters. The two other extremities of the stanchions are intended to rest on a support surface, such as on a vertical wall (case of a simple ladder) or are joined to a support structure able to consist of a second ladder (case of double ladder).

In the case of a double ladder, the stanchions constitute shafts bearing steps instead of rungs. In this case, the support structure includes two parallel stanchions connected together by crosspieces and to the shafts by disconnectable bracing means.

Generally speaking, so as to ensure his balance, the user mounted on a ladder is often obliged to keep one hand on the bars or on the stanchion and thus is not fully free to move as he would like. This drawback is particularly prejudicial when the user has to carry out works, such as painting work requiring the simultaneous use of both hands.

Another problem put forward by conventional solutions concerns the a stability of the ladder and the risk of the user falling, it being understood that this stability can only be attained if the vertical projection of the centre of gravity of the user and/or the ladder occurs inside the support polygon of the ladder, that is a polygon formed by the vertical projection inside a horizontal plane of the support points of the ladder.

Now the dimensions of this support polygon vary according to the location of the support points of the ladder, whereas there is nothing enabling the user to indicate the position of his centre of gravity with respect to this polygon.

Thus, the user can find himself out of balance and fall without receiving any sign warning him of this danger.

This drawback is clearly shown in the case of double ladders or stepladders which comprise four support points on the ground. Having regard to the irregularities of the shape of the ground, the ladder or stepladder in fact most often only rests on three legs which considerably reduces the dimensions of the support polygon. In addition, the verticality of the ladder or stepladder is relatively difficult to obtain which further increases the risks of falling.

OBJECT OF THE INVENTION

Thus, the main object of the invention is to eliminate these drawbacks and resolve these problems. These results can be attained by using a relatively simple structure able to be easily folded yet being less expensive.

SUMMARY OF THE INVENTION

According to the invention, this structure includes at least:

a shaft whose two extremities are intended to come into support on two fixed elements, one of these elements possibly consisting of the ground and the other a fixed object situated above the ground, two sets of steps secured to the shaft respectively on both sides of the latter.

According to the invention, this structure is characterised in that one of the extremities of the shaft constitutes one of the support means on the ground, whereas two legs are joined to the other extremity so as to obtain in a deployed state a tripod structure, and in that it comprises a ramp, integral with the shaft and extending to the vertical position of the latter at a distance of steps less than the average length of a leg so that a user is able to move on the steps by straddling the ramp and able to tighten said ramp between his legs so as to stay on the structure without having to use his hands which remain free for carrying out work operations.

At the same time, this double support on the ramp tends to bring the user back into a vertical plane in a position where he benefits from having better stability.

Advantageously, the steps could include means for the lateral side locking of the legs so as to ensure improved structure/user integration when the user tightly holds the ramp between his legs.

BRIEF DESCRIPTION OF THE DRAWINGS

One embodiment of the invention appears hereafter given by way of non-restrictive example with reference to the accompanying drawings on which.

DESCRIPTION OF THE PREFERRED EMBODIMENTS

Figure 1:
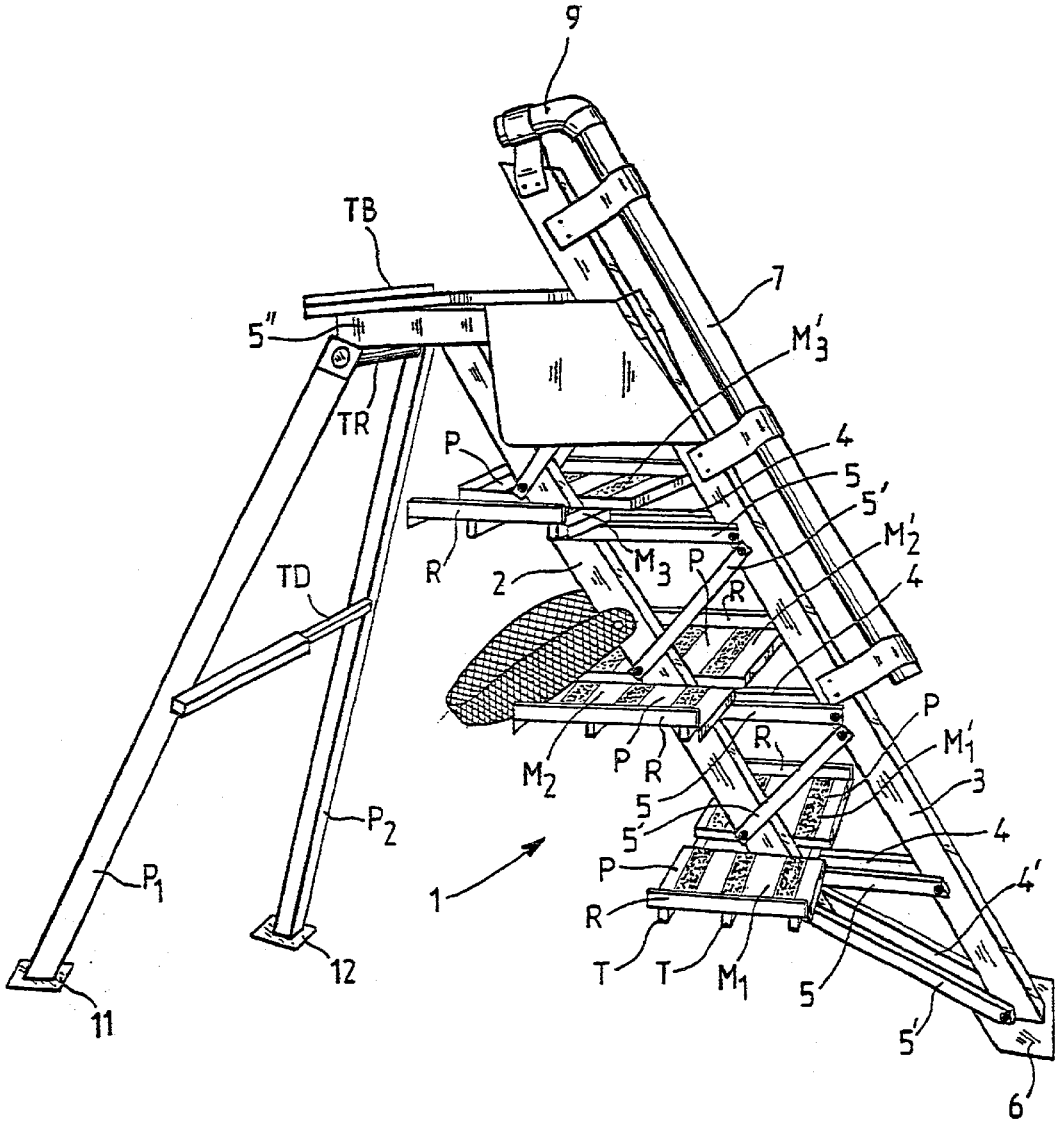
FIGS. 1 and 2 are perspective ¾ front (FIG. 1) and ¾ rear (FIG. 2) views of a ladder/stepladder according to the invention.
Figure 2:
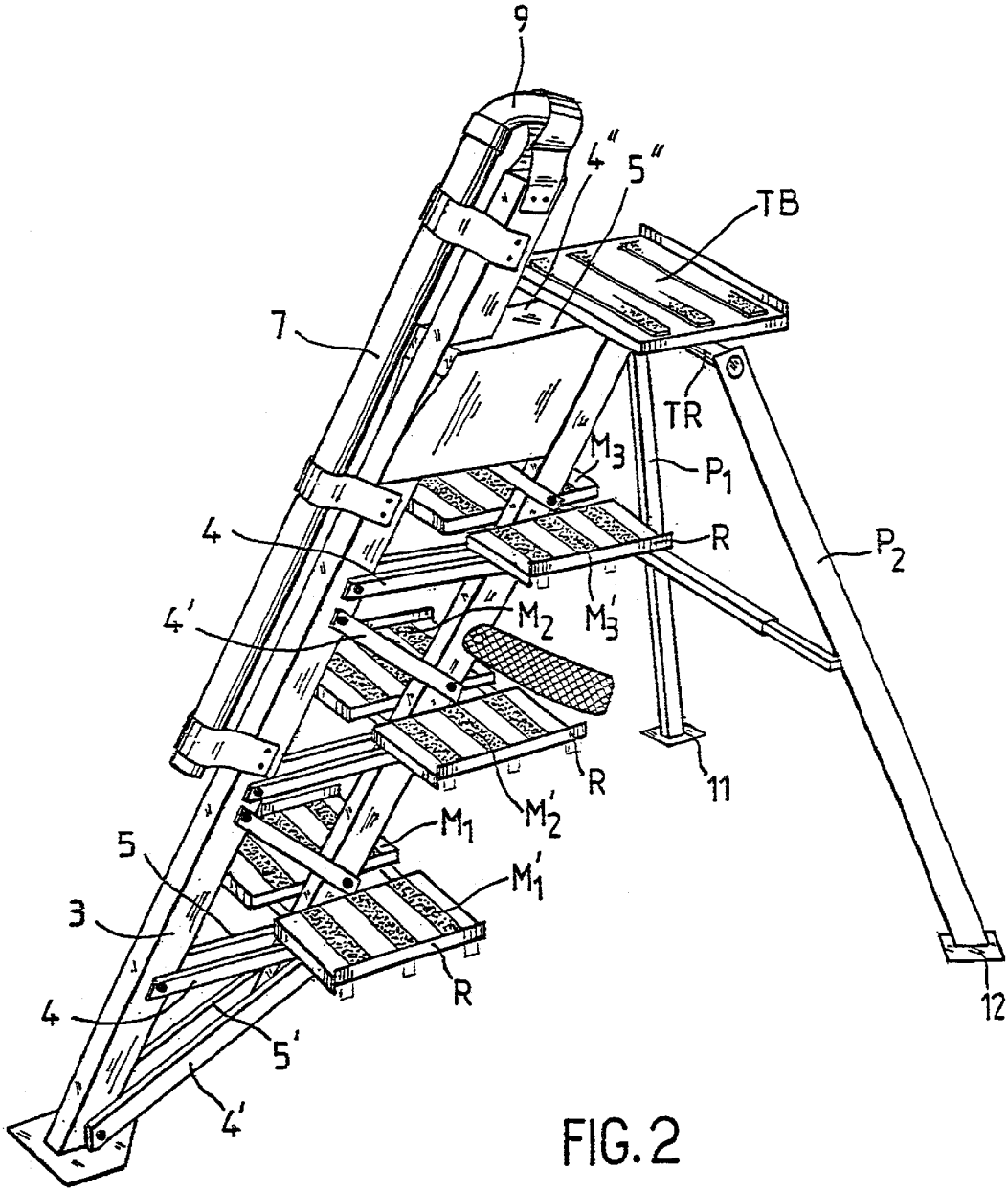
Figure 3:
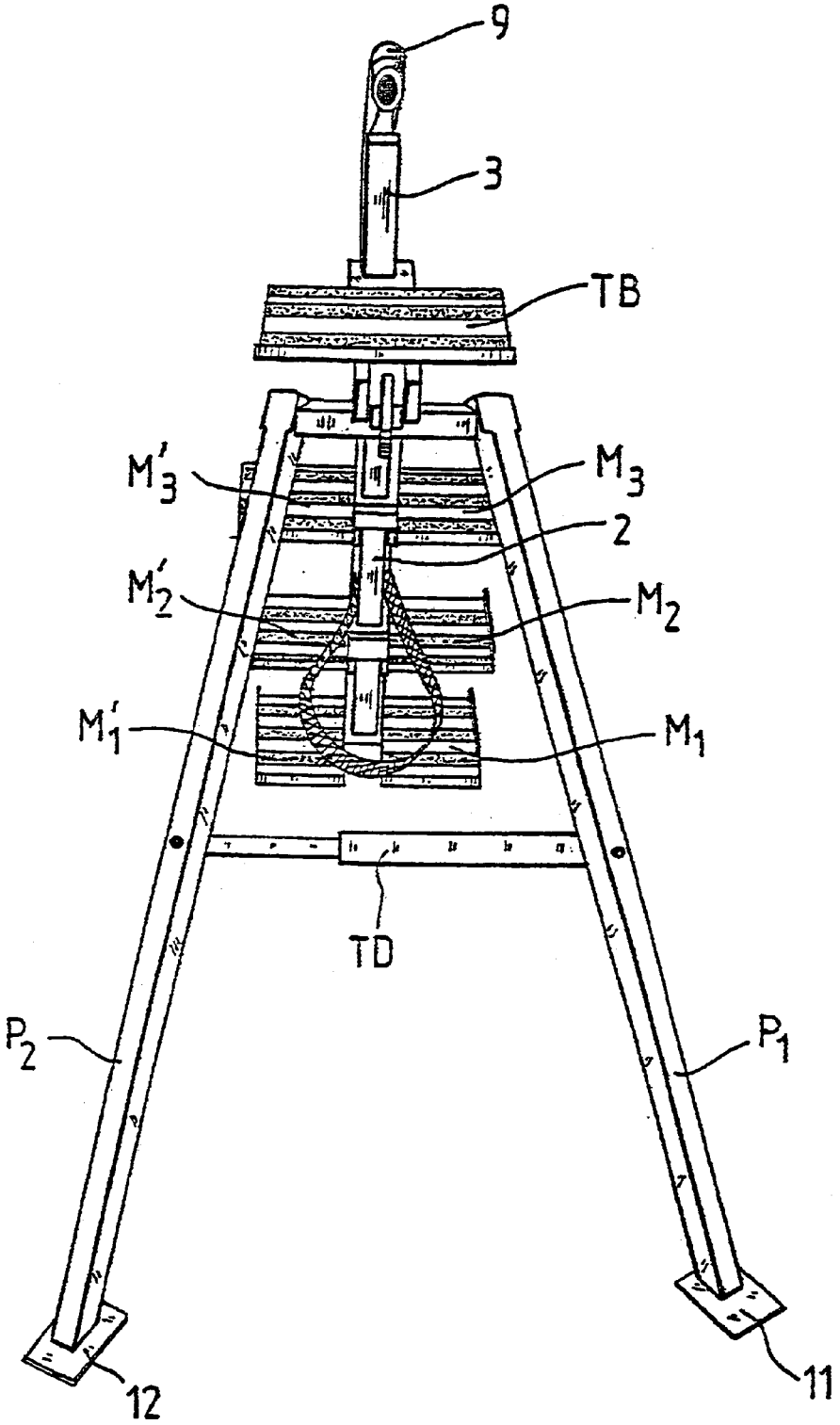
FIG. 3 is a front view of the ladder/stepladder shown on FIGS. 1 and 2.

In this example, the shaft 1 of the ladder/stepladder is constituted by two longitudinal girders 2, 3, each consisting of an aluminium profile with a rectangular section. These two longitudinal girders 2, 3 extend parallel with respect to each other and are rendered integral with each other by means of two sets of oblique bracing rocker bars 4, 5–4', 5' secured to the longitudinal girders 2, 3 via their extremities.

One of the two longitudinal girders 3, slightly longer than the other 2, is ended at the bottom by a bolster 6 intended to come into support on the ground. This longitudinal girder 3 bears a ramp 7 with a circular section extending above the shaft 1 inside a given vertical plane. The fixing of the ramp 7 on the shaft 1 is ensured by a set of collars secured to the longitudinal girder 3. In its upper portion, the ramp 7 forms an elbow 9 partially surrounding the extremity of the longitudinal girder 3.

As for the longitudinal girder 2, this supports a succession of double steps $M_1$, $M'_1$–$M_2$, $M'_2$–$M_3$, $M'_3$ each extending transversally on both sides of the vertical plane of the shaft 1.

In this example, these double steps $M_1$, $M'_1$–$M_2$, $M'_2$–$M_3$, $M'_3$ each include two plates P extending horizontally on both sides of the plane of the shaft 1 and which are borne by tubular crosspieces T bolted onto a pair of horizontal rocker bars 4, 5.

This pair of horizontal rocker bars 4, 5 is here crossbraced by a pair of oblique rocker bars 4', 5' extending into the gap formed between said rocker bars 4, 5 and the step located immediately above.

Advantageously, the plates P are provided with anti-skid relief elements u and each having at their side borders a double fold R towards the top used for ensuring that the feet of the user are unable to skid sideways.

The pair of horizontal rocker bars 4, 5 situated at the upper extremity of the shaft 1 supports a shelf TB, also anti-skid, on which an object, such as a paint pot, can be laid. This pair of rocker bars 4"5" having a section larger than that of the rocker bars 4, 5, bears below the shelf a crosspiece TR on whose extremities two feet $P_1$, $P_2$ are joined ended at their lower extremities by support bolsters 11, 12 on the ground.

In the deployed state, these feet $P_1$, $P_2$ form along with the longitudinal girders 3 a tripod which delimits a prismatic volume inside which the steps $M_1$, $M'_1$–$M_2$, $M'_2$–$M_3$, $M'_3$ are arranged below the longitudinal girder 3. In this position, the two feet $P_1$, $P_2$ are rendered integral by means of a disconnectable crosspiece TD.

By means of these arrangements, the ladder/stepladder offers the user unequalled stability and safety.

Because of its tripod structure, the ladder/stepladder can be placed on possibly uneven floors, it being understood that the user shall make every effort to ensure that his plane of symmetry is vertical.

In all cases, the user mounted on the ladder/stepladder could form a body with the latter by holding the ramp tight between his legs. Because of this, the vertical plane of symmetry of the user in which his centre of gravity is located is brought back into the vertical plane of symmetry of the ladder/stepladder (bisectional plane of the dihedron formed by the shaft 1 and the two legs $P_1$, $P_2$).

Because of this, the vertical of the centre of gravity of the stepladder/ladder/user unit thus moves positively inside the support polygon of the ladder/stepladder. The stability of the unit is thus guaranteed.

This stability stays excellent; even when the user uses his two hands to carry out work operations and is obliged to keep the ramp tight between his legs.

Another significant advantage of the ladder/stepladder previously described consists of the fact that it can be folded so as to only occupy in this folded state a highly reduced volume. In this position, the user can make use of the ramp 7 to carry the ladder/stepladder.

Figure 4:
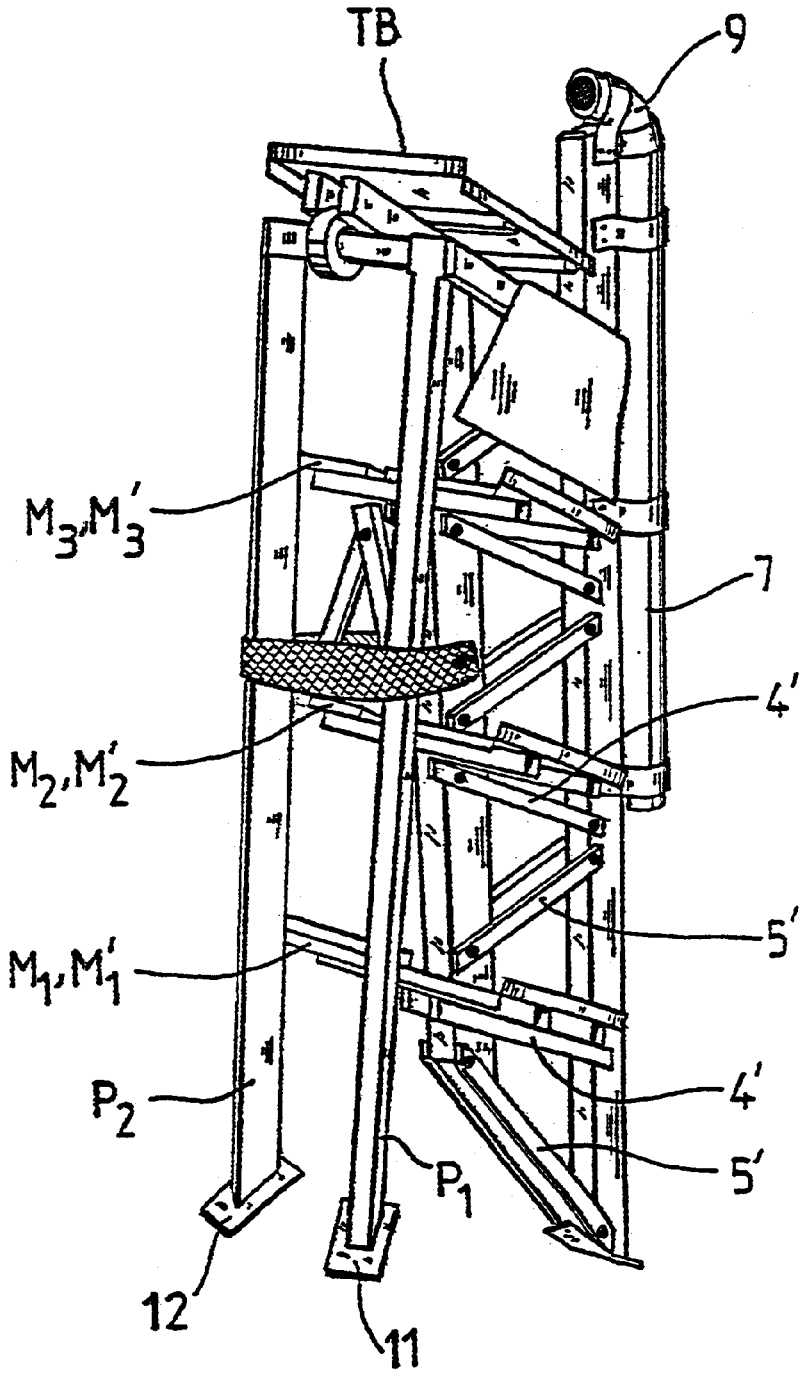
FIG. 4 shows the ladder/stepladder in a folded state.

In fact, the two feet can be folded down against the shaft 1 so that the volume of the unit in a folded state is significantly reduced to the dimensions of the shaft 1 and the steps $M_1$, $M'_1$–$M_2$, $M'_2$–$M_3$, $M'_3$ (FIG. 4).

In the previously described example, the steps $M_1$, $M'_1$–$M_2$, $M'_2$–$M_3$, $M'_3$ could occupy positions offset in height by about 21 cm, the shaft being slanted by about 30°.

The width of the shaft 1 (distance separating its upper and lower edges) is such that the vertical plumb with the first third of a step cuts again the upper edge of the "shaft" at a height of about 40 cm.

The ramp 7 is situated about 40 cm above the steps so as to be able to come into support between the calves and knees of the user.

Of course, the invention is not limited to the previously described embodiment.

Thus, for example the length of the feet $P_1$, $P_2$ of the ladder/stepladder could be adjusted so as to allow an adjustment of verticality, especially in the case of an uneven floor. To this effect, each foot $P_1$, $P_2$ could include two elements with one being nested telescopically inside the other, and fixing means to render integral the two elements in the axial position corresponding to the length of the foot it is desired to obtain.

Furthermore, said ramp could consist of the upper longitudinal girder 3 of the shaft 1. Said shaft could be extended beyond its upper extremity by a ramp section telescopically engaged inside the longitudinal girder 3. An axial multiposition locking of this section in the longitudinal girder could then be ensured by known fixing means.

The upper extremity of this section could be equipped with a hook or similar element and able to be used to hang an object, such as a pot or a basket.

The feet are preferably orientated so that the upper extremity of the shaft 1 is located approximately to the vertical of the centre of gravity of the triangle formed by the bolsters 6, 11, 12.

In this case, the stability of the structure/user unit shall gradually increase as the steps are mounted so as to become maximum at the level of the final step, the centre of gravity of the user then being found at the vertical of the centre of gravity of the support polygon.

What is claimed is:

1. Portable structure able to be used as a ladder or stepladder to enable a person to go up or down, said structure comprising one shaft having a lower end portion which constitutes a first support means and an upper second portion hinged on two rigid legs having lower end portions which constitute second and third support means, said shaft and said rigid legs forming a tripod structure in a deployed state, said shaft being provided with two sets of steps respectively secured on two lateral sides of said shaft and with a ramp user is able to move on the steps by straddling the ramp and can keep said ramps tight between his legs so as to remain on the structure without having to use his cards.

2. Structure according to claim 1, wherein the steps of said two sets of steps include means for side locking the feet of said user so as to improve integrality between said structure and said user when said user is tighting said ramp between his legs.

3. Structure according to claim 1, wherein said shaft comprises first and second longitudinal girders secured to each other by pairs of bracing rocker bars, said first longitudinal girders being slightly longer than the other and being ended at the bottom by a support bolster on the ground.

4. Structure according to claim 3, wherein said ramp is secured to said first longitudinal girder, whereas said steps are supported by the second longitudinal girder.

5. Structure according to claim 3, wherein said ramp consists of said first longitudinal girder.

6. Structure according to claim 3, wherein said first and second girders are linked together by first and second sets of pairs of bracing rocker bars, the pairs of the first set being horizontal, whereas the pairs of the second set are oblique and ensure a crossbracing of the horizontal rocker bars and in that the pairs of the horizontal rocker bars each support one pair of steps extending transversally on both sides of the shaft.

7. Structure according to claim 1, wherein the steps of said two sets of steps comprise plates fitted with anti-skid elements and having lateral borders folded upwards.

8. Structure according to claim 1, which comprises a pair of horizontal rocker bars secured to the said upper end of the shaft and supporting a table on which an object can be placed, said rocker bars bearing a crosspiece having two extremities on which said two legs are respectively hinged.

9. Structure according to claim 1, wherein said rigid legs are orientated so that said upper end portion of the shaft is located approximately to the vertical of a centre of a triangle formed by the said supports means on the ground.

10. Structure according to claim 1, wherein said legs are linked integral by a disconnectable crosspiece.

11. Portable structure able to be used as a ladder or stepladder to enable a person to go up or down, said structure comprising one shaft having a lower end portion which constitutes a first support means and an upper second end portion hinged on two rigid legs having lower end portions which constitute second and third support means, said shaft and said rigid legs forming a tripod structure in a deployed state, said shaft being provided with two sets of steps respectively secured on two lateral sides of said shaft and with a ramp and is provided with a ramp section having a looked extremity which is telescopically engage in said ramps.

* * * * *